US010168118B2

(12) United States Patent
Abbott

(10) Patent No.: US 10,168,118 B2
(45) Date of Patent: Jan. 1, 2019

(54) BARREL CLAMP

(71) Applicant: Brian F. Abbott, Fort Worth, TX (US)

(72) Inventor: Brian F. Abbott, Fort Worth, TX (US)

( * ) Notice: Subject to any disclaimer, the term of this patent is extended or adjusted under 35 U.S.C. 154(b) by 0 days.

(21) Appl. No.: 15/000,293

(22) Filed: Jan. 19, 2016

(65) Prior Publication Data

US 2017/0205177 A1 Jul. 20, 2017

(51) Int. Cl.

| | |
|---|---|
| ***F41F 1/10*** | (2006.01) |
| ***F41A 21/34*** | (2006.01) |
| ***F41A 21/08*** | (2006.01) |
| ***F41A 21/24*** | (2006.01) |
| ***F41A 21/48*** | (2006.01) |

(52) U.S. Cl.

CPC ..... *F41A 21/34* (2013.01); *F41A 21/08* (2013.01); *F41A 21/24* (2013.01); *F41A 21/487* (2013.01); *F41F 1/10* (2013.01)

(58) Field of Classification Search

CPC ..... F41F 1/08; F41F 1/085; F41F 1/10; F41A 9/36; F41A 7/10

USPC ..... 89/9, 12, 13.05, 13.1, 14.1

See application file for complete search history.

(56) References Cited

U.S. PATENT DOCUMENTS

| | | | | | |
|---|---|---|---|---|---|
| 1,328,230 | A * | 1/1920 | Johnston | F41A 9/35 | 89/1.1 |
| 3,703,122 | A * | 11/1972 | Farrington | F41A 21/32 | 89/14.3 |
| 3,898,910 | A * | 8/1975 | Groff | F41A 21/32 | 89/14.3 |
| 4,015,508 | A * | 4/1977 | Blodgett, Jr. | F41F 1/10 | 89/12 |
| 2016/0091270 | A1* | 3/2016 | Rowe | F41A 21/487 | 89/14.2 |

FOREIGN PATENT DOCUMENTS

| | | | |
|---|---|---|---|
| FR | 846.077 | * | 5/1939 |

* cited by examiner

*Primary Examiner* — Stephen Johnson

(74) *Attorney, Agent, or Firm* — Dobbin IP Law, P.C.; Geoffrey E. Dobbin

(57) ABSTRACT

A barrel clamp for a Gatling-style firearm, or "mini-gun," provides vanes for the direction of fresh air currents into the muzzle area of the firearm. The directed air streams contribute to cooling the barrels while in the firing cycle and also towards the disruption of fuel-rich gasses which contribute to muzzle flash.

12 Claims, 6 Drawing Sheets

BARREL CLAMP

FIELD OF THE INVENTION

The present invention relates to the field of firearms and more particularly relates to a barrel clamp for a multiple barreled rotary firearm.

BACKGROUND OF THE INVENTION

The modern "mini-gun," or M-134, can trace its origins to the original Gatling gun of the mid-nineteenth century. It is a machine gun which fires projectiles in an automatic fashion. In the process of firing these projectiles, the gun utilizes a plurality of barrels (usually six) which consecutively rotate in a circular circuit into a single position which allows for the firing of a projectile. Each barrel, then, is only used to fire one-sixth of the projectiles, spending the remaining time cooling in an air current caused by the rotation of the barrels. Over time, many improvements have been made to the original Gatling gun, resulting in the modern M-134. However, each variant of the M-134 has always featured the rotatable barrels which are the signature characteristic of this family of firearms.

Muzzle flash is a problem for many firearms, and the M-134 and other multi-barreled firearms are no exception. Muzzle flash is a complex phenomenon with a number of components. Two primary components of muzzle flash are unburnt powder/explosive and the mixing of ambient air and gasses from the firing explosion. Hot, fuel-rich gasses mix with ambient air in the latter case, causing an explosive flash. In the case of the former, the unburnt powder sparks as it leaves the barrel, causing a source of light and heat. In the case of a multi-barreled firearm such as an M-134, the problem of muzzle flash is compounded by ammunition being rapidly fired. This presents not only more opportunity for muzzle flash, but also a potential for component build-up leading to larger and more noticeable muzzle flashes.

Many strategies have been developed in the past to combat muzzle flash, in particular with the M-134 and its variants. One of the most common is to attempt to hide the flash with a large collar around the barrels; but, this method really does not solve the problem as muzzle flash still occurs and may be seen at certain angles outside of a target zone. Other mechanical methods of reducing muzzle flash, specifically using flash suppressors and muzzle brakes, have also been attempted. These devices tend to disrupt the flow of propulsive gasses, in particular the initial shock wave from the explosion, which contribute to the muzzle flash. However, this strategy would require a suppressor on each barrel of an M-134 or other rotary multi-barreled weapon. Another strategy is to add chemical compounds, usually salts, to the powder so as to neutralize the fuel-rich gasses. However, this strategy tends to increase both smoke and residue.

The present invention is a barrel clamp for a Gatling-style, multi-barreled, rotary firearm, such as the M-134, which not only serves to support the barrels of the firearm, but also features vanes which direct airflow inward in a manner to lessen muzzle flash and also assist in cooling barrels after use in the firing cycle. Prior art barrel clamps and muzzle brakes have used vanes in an effort to direct airflow associated with firing a mini-gun, however these structures were used to deflect the expanding muzzle gasses outward, reducing pressure around the barrels and contributing torque to the system in an effort to assist the rotation of the barrels.

Directing fresh air into the system increases torque against the rotation of the barrels and is counter-intuitive to traditional designs.

The present invention represents a departure from the prior art in that the barrel clamp of the present invention directs fresh air currents onto the barrels of the firearm and doing so in a manner to disrupt the accumulation of fuel-rich gasses from the act of firing ammunition, thus reducing muzzle flash.

SUMMARY OF THE INVENTION

In view of the foregoing disadvantages inherent in the known types of barrel clamps and muzzle flash suppression devices, a barrel clamp for a multi-barreled firearm, such as for an M-134, may direct fresh air into proximity of firing barrels, thereby disrupting the mixture of firing gasses and dissipating unburnt explosive residue before they can produce muzzle flash. Such a barrel clamp should be easily installed and effective as a barrel clamp on existing and newly developed platforms, effective in the dissipation of combustible by-products which contribute to muzzle flash, intuitive in use and operation, and robust in construction.

To accomplish these objectives, the barrel clamp may comprise a brace plate with a central support tube extending therefrom. A muzzle housing may reside at an end of the support tube opposite the base plate, surrounding the muzzle ends of the multiple barrels of the firearm. The barrel housing may feature at least one vane, which may serve to direct ambient, fresh air directly onto one or more muzzles and associated barrels. By directing fresh air inwards and onto the barrels, the barrel clamp would directly contribute to both the cooling of the barrels and to the dispelling of left over explosive gasses from firing each round of ammunition. This, in turn, would reduce muzzle flash and allow for more rapid rates of fire. Ideally, there could be at least one vane for each barrel as this would evenly distribute fresh air for the cooling effect of the barrel clamp.

The more important features of a barrel clamp serving as one embodiment of the invention thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the barrel clamp is herein described. It should be noted that the articles "a", "an", and "the", as used in this specification, include plural referents unless the content clearly dictates otherwise.

Figure 1:
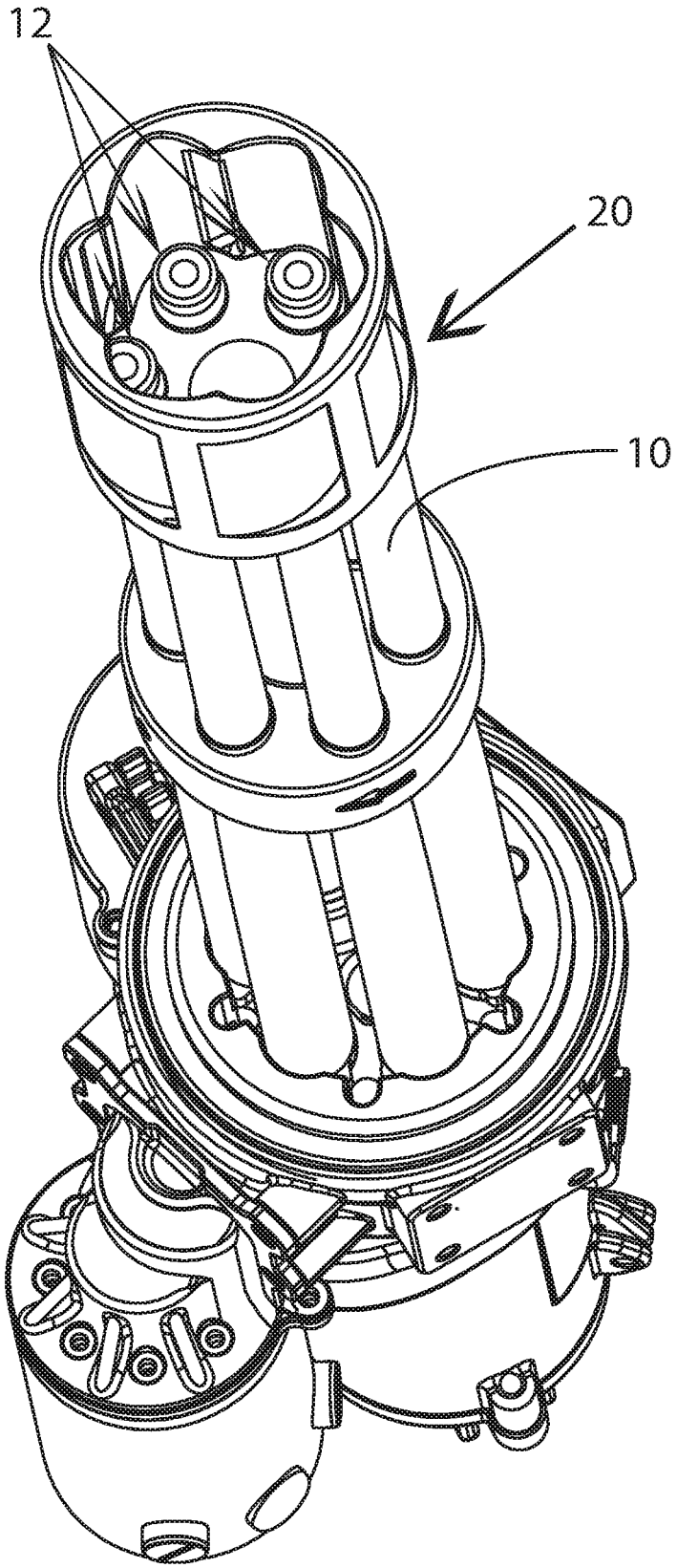
FIG. 1 is a perspective view of an M-134 variant machine gun with a barrel clamp that exemplifies one embodiment of the present invention.
Figure 2:
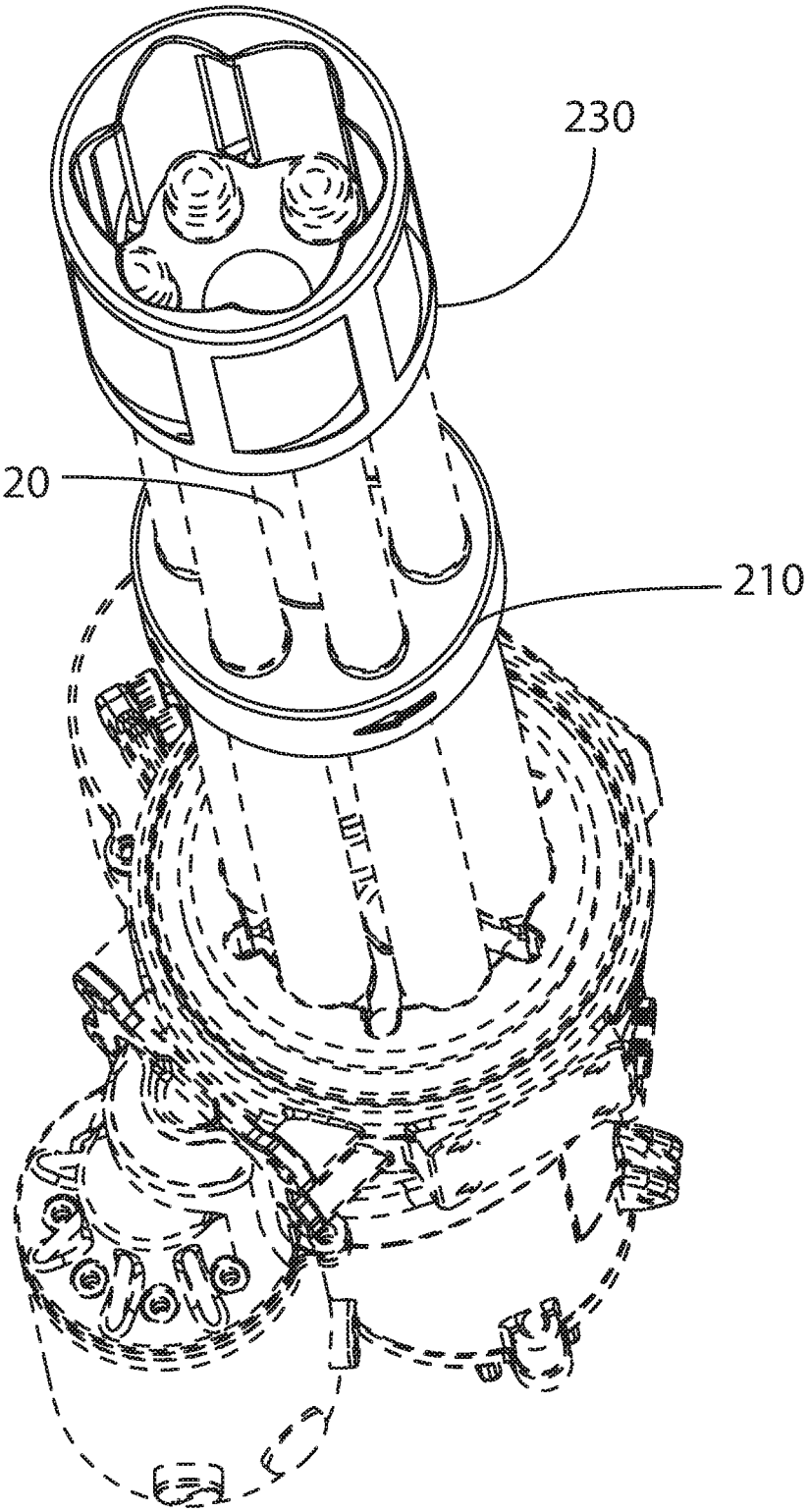
FIG. 2 is a perspective view of the machine gun of FIG. 1, in broken line, highlighting the barrel clamp.
Figure 3:
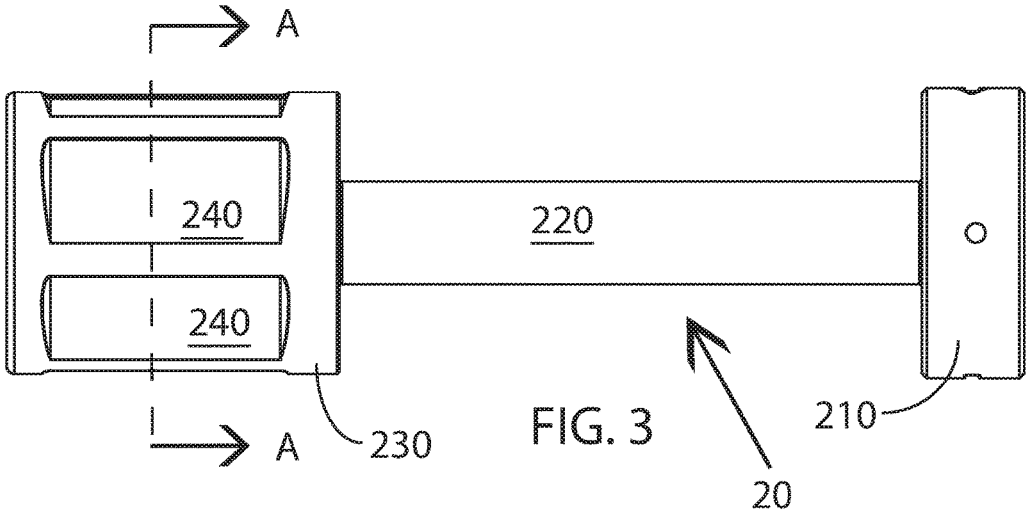
FIG. 3 is a side elevation of the barrel clamp of FIG. 2.
Figure 4:
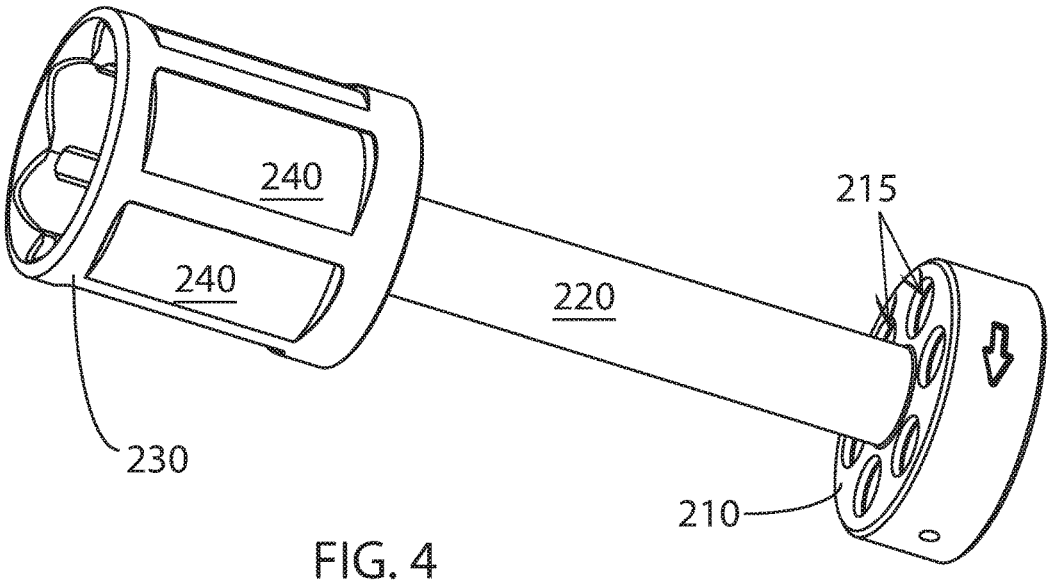
FIG. 4 is a perspective view of the barrel clamp of FIG. 2.
Figure 5:
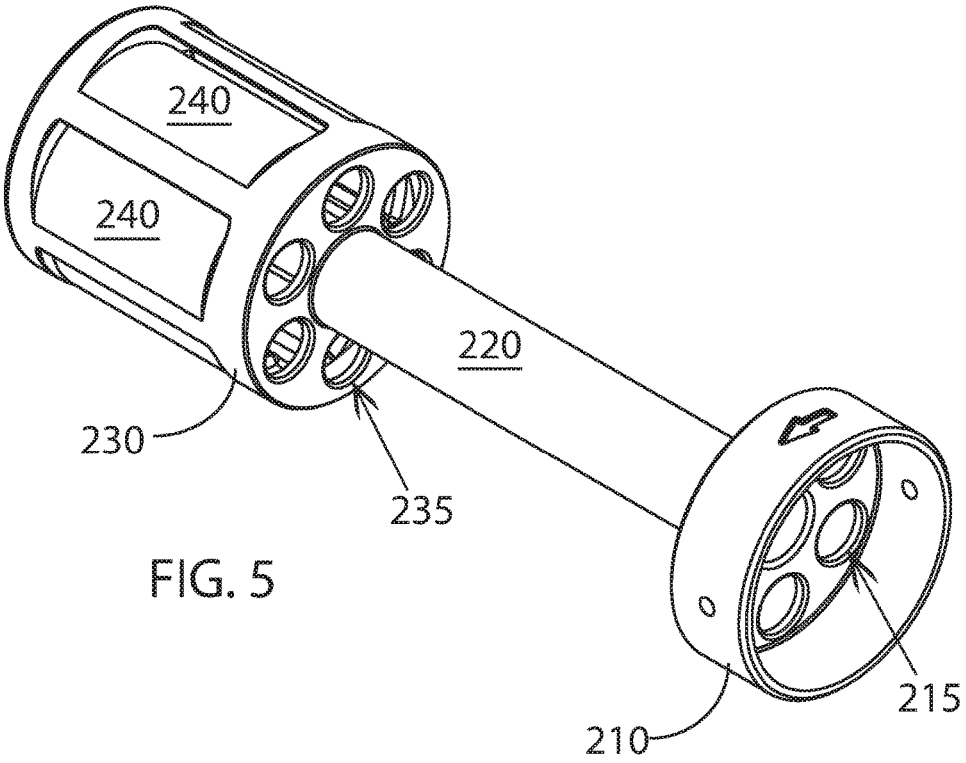
FIG. 5 is an alternate perspective view of the barrel clamp of FIG. 2
Figure 6:
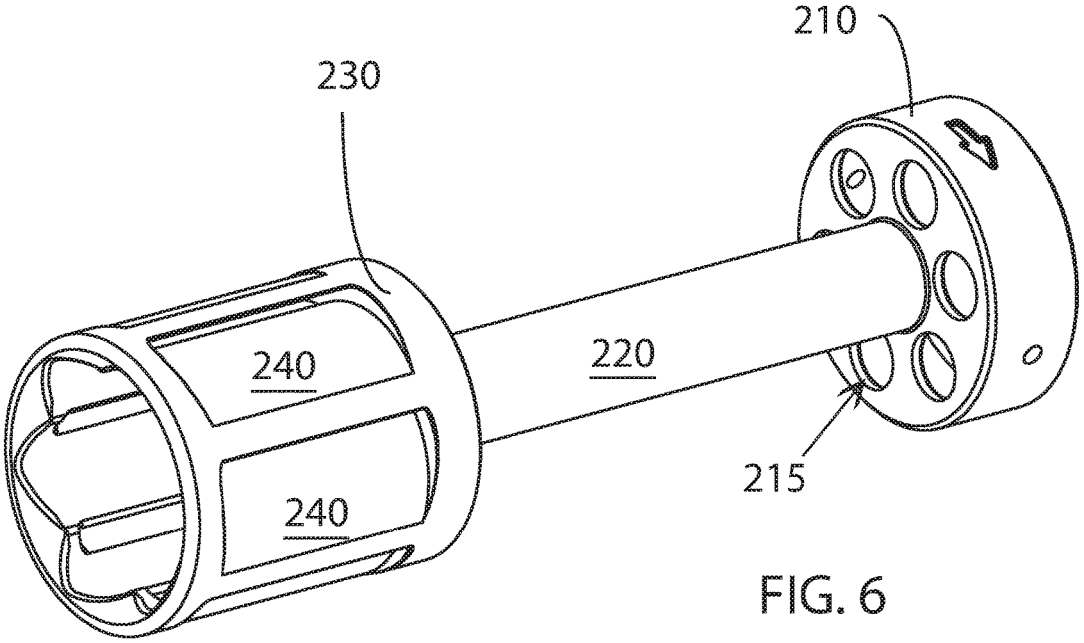
FIG. 6 is an alternate perspective view of the barrel clamp of FIG. 2.
Figure 7:
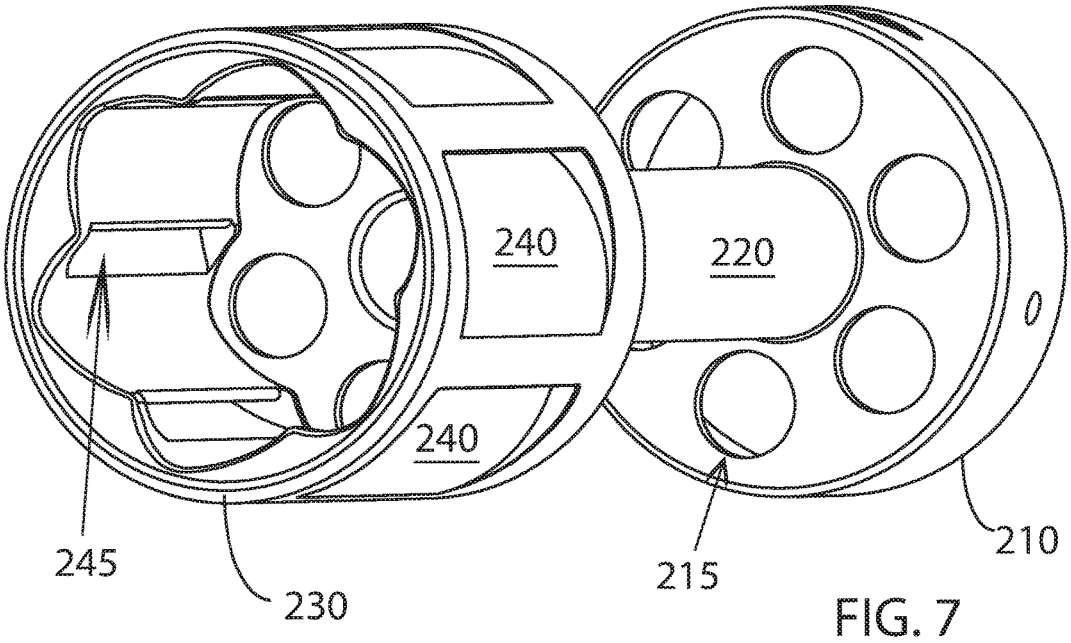
FIG. 7 is an alternate perspective view of the barrel clamp of FIG. 2, emphasizing the muzzle area.
Figure 8:
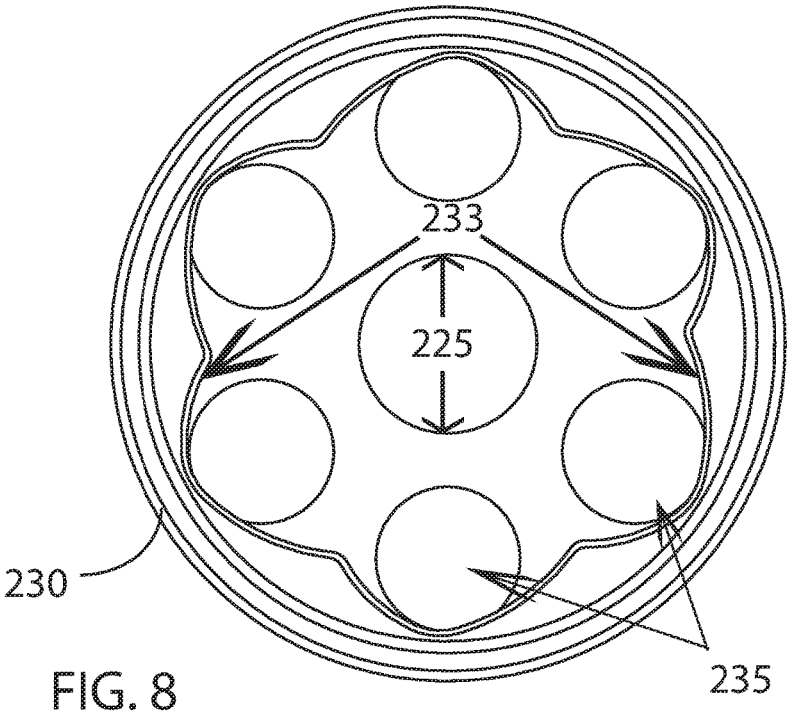
FIG. 8 is a front elevation of the barrel clamp of FIG. 2.
Figure 9:
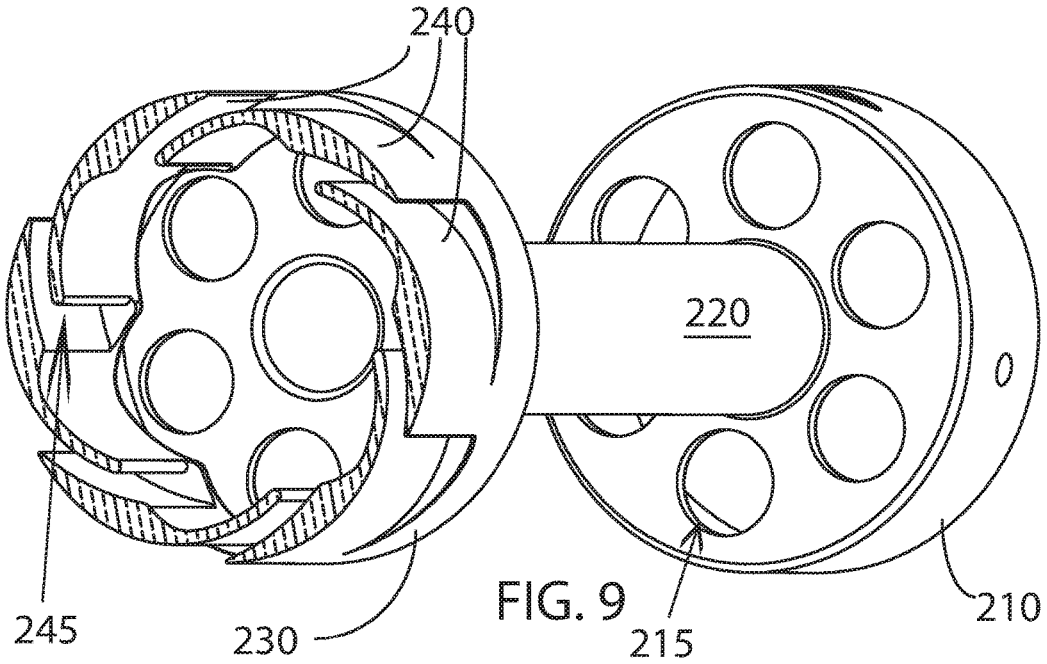
FIG. 9 is a sectional view of the barrel clamp of FIG. 7, taken along line A-A in FIG. 3.

With reference to FIGS. 1 and 2, the barrel clamp 20 is a part of a comprehensive rotating, multi-barrel weapon system that directly supports barrels 10 at two locations along their length, near muzzles 12 and at some point further along the length of the barrel 10 as determined by the manufacturer. As seen in FIGS. 3 and 4, the barrel clamp is a simple construction. It features a base plate 210 at one end of a support tube 220 and a muzzle housing 230 at the support tube's opposite end. The base plate 210 and muzzle housing 230 each feature paired holes 215, 235, one of each pair being located on the muzzle housing 230 and one located on the base plate 210, through which the barrels 10 extend (FIGS. 5 and 6). The barrel clamp 20 helps maintain position of the barrels 10 relative to each other and the weapon system as a whole. This is the primary function of any barrel clamp.

Figure 10:
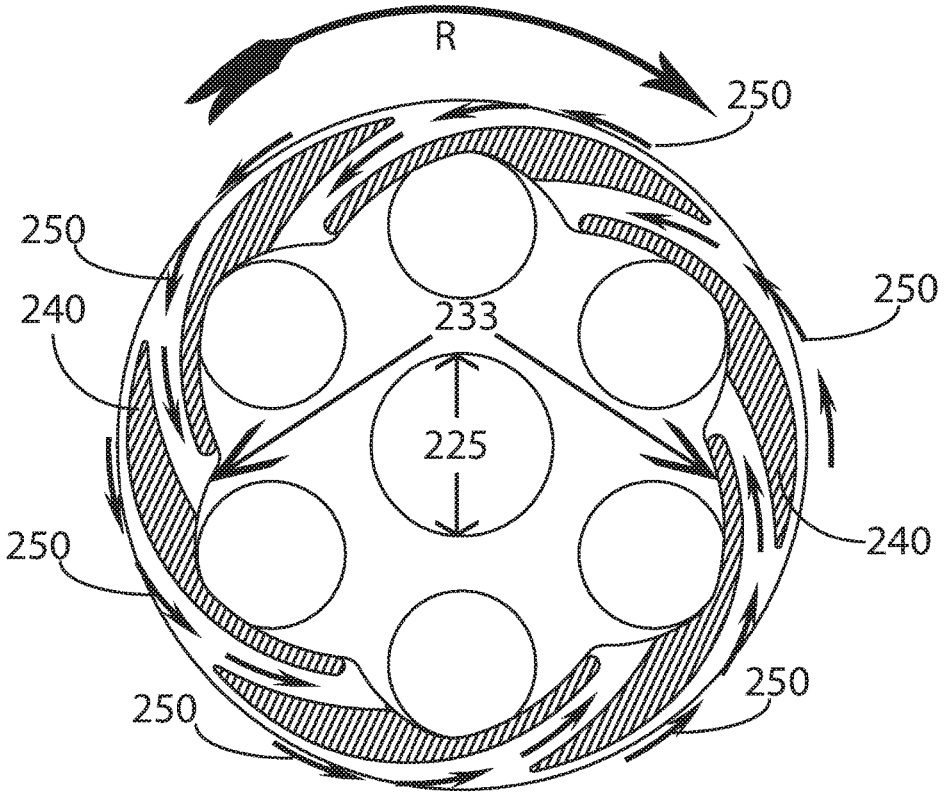
FIG. 10 is a sectional view of the barrel clamp of FIG. 8, taken along line A-A in FIG. 3.

With reference to FIGS. 5-10, the muzzle housing 230 of the barrel clamp 20 also features a wall with a plurality of vanes 240 and associated vents 245. The vanes 240 are positioned such that rotation R of the barrels 10 and the associated barrel clamp 20 will direct fresh air through the vents 245 and over the barrels 10 of the weapon (FIG. 10). The barrels 10 are therefore constantly bathed in streams of fresh air 250 while the barrels 10 are in motion. This directly aids in the cooling of those barrels 10, particularly in the vicinity of the muzzles 12. The constant air currents 250 also interrupt the accumulation of fuel-rich exhaust gasses from the constant explosions of projectiles being fired from the barrels 10. These gasses are forced to leave the higher-pressure, central chamber 233 inside the muzzle housing 230 and are thus dissipated, reducing their presence and ability to cause muzzle flash.

In the best mode, the support tube 220 is hollow, providing a possible egress 225 for exhaust gasses. The use of a tube also reduces the weight of the clamp 20 and the associated system. However, it is conceivable that a solid rod may be used in place of a tube.

Ideally, the air currents 250 are directed on the barrels 10 of the weapon (or towards holes 235, representing the position of barrels 10 when the barrel clamp is installed thereon) as this aids in cooling the barrels 10. The vanes 240 should direct the air currents 250 such that a maximal amount of the barrels 10 are covered by the air currents 250. Also, the number of vanes 240 should comport with the number of barrels 10 (usually 6), in either having that number or a whole number multiple thereof, such that each barrel has at least one air current 250 directed upon it. However, any number of vanes 240 will at least contribute to the dissipation of exhaust gasses and have some cooling effect on the barrels.

Given the nature of the use of the barrel clamp, it is readily understood that strong, supportive materials, such as metals, are preferred. However, any material of sufficient strength, such as a composite or polymers, may also be utilized. It is also to be understood that while this barrel clamp has been described with reference to the modern M-134 and its current variants, the principals of this invention may be applied to any multi-barreled, rotary firearm in existence or later developed and is not unique to an M-134 platform.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A barrel clamp comprising:

a. a base plate;

b. a central support structure defining an axis; and c. a muzzle housing positioned on an extreme end of the support structure opposite the base plate, said muzzle housing further comprising a wall with a plurality of vanes, each with at least one associated vent, each said vent positioned to direct airflow into a central chamber of the muzzle housing when the barrel clamp is rotated about the axis, wherein the base plate and said muzzle housing each have a plurality of orifices such that there is an equal number of said orifices on the base plate and on the muzzle housing, each said orifice on the muzzle housing being paired to an opposed said orifice on the base plate so that barrels may be inserted therethrough, with each said orifice on said muzzle housing opening inside the central chamber.

2. The barrel clamp of claim 1, the plurality of said vanes equaling the plurality of said orifices in the muzzle housing.

3. The barrel clamp of claim 2, each said vane and each said vent being positioned in a manner to direct airflow over one of the orifices in the muzzle housing.

4. The barrel clamp of claim 1, each said vane and each said vent being positioned in a manner to direct airflow over one of the orifices in the muzzle housing.

5. The barrel clamp of claim 1, the support structure being a tube with an opening in the central chamber of the muzzle housing, said opening serving as a vent.

6. The barrel clamp of claim 5, the plurality of said vanes equaling the plurality of said orifices in the muzzle housing.

7. The barrel clamp of claim 6, each said vane and each said vent being positioned in a manner to direct airflow over one of the orifices in the muzzle housing.

8. The barrel clamp of claim 5, each said vane and each said vent being positioned in a manner to direct airflow over one of the orifices in the muzzle housing.

9. A barrel clamp comprising:

a. a base plate;

b. a central tube support structure having a length greater than its diameter, said length defining an axis; and c. a muzzle housing, said muzzle housing further comprising a plurality of vanes, each associated with one of a plurality of wall vents positioned to direct airflow into a central chamber of the muzzle housing when the barrel clamp is rotated about the axis, d. the central support tube having an opening within the central chamber of the muzzle housing serving as a central vent;

wherein the base plate and said muzzle housing each have a plurality of orifices such that there is an equal number of said orifices on the base plate and on the muzzle housing, each said orifice on the muzzle housing being paired to an opposed said orifice on the base plate so barrels may be inserted therethrough, with each said orifice on said muzzle housing opening inside the central chamber.

10. The barrel clamp of claim 9, the plurality of said vanes equaling the plurality of said orifices in the muzzle housing.

11. The barrel clamp of claim 10, each said vane and each said wall vent being positioned in a manner to direct airflow over one of the orifices in the muzzle housing.

12. The barrel clamp of claim 9, each said vane and each said wall vent being positioned in a manner to direct airflow over one of the orifices in the muzzle housing.

* * * * *